US005971560A

United States Patent [19]

Chen

[11] Patent Number: 5,971,560

[45] Date of Patent: Oct. 26, 1999

[54] LIGHT DEVICE FOR A TOOL

[76] Inventor: Cheng Chia Chen, P.O. Box 63-99, Taichung, Taiwan, 406

[21] Appl. No.: 09/157,159

[22] Filed: Sep. 18, 1998

[51] Int. Cl.[6] ..... B25B 23/18

[52] U.S. Cl. ..... 362/119; 362/120

[58] Field of Search ..... 362/109, 119, 362/120, 253, 208; 7/165; 81/177.4

[56] References Cited

U.S. PATENT DOCUMENTS 5,515,249 5/1996 Shiao ..... 362/119
5,713,656 2/1998 Lin ..... 362/120
5,733,034 3/1998 Jan ..... 362/119

*Primary Examiner*—Y. Quach

[57] ABSTRACT

A tool includes one or more batteries received in a base which has a number of sockets for receiving tool bits. A cap is attached to the base for retaining the batteries in place. A knob is pivotally coupled to the cap at a pivot shaft. A light bulb is secured to the knob and is selectively coupled to the batteries for energizing the light bulb when the knob is rotated to the working position. The cap has a number of openings for aligning with the tool bits and for allowing the tool bits to be removed from the base. The tool bits are retained in place when the openings are disengaged from the tool bits.

8 Claims, 4 Drawing Sheets

LIGHT DEVICE FOR A TOOL

BACKGROUND OF THE INVENTION

1. Field of the Invention

The present invention relates to a tool, and more particularly to a tool having a light device.

2. Description of the Prior Art

Typical tools comprise a light device engaged in the tool body which includes a complicated configuration for receiving the light device. The light device also includes a complicated configuration.

The present invention has arisen to mitigate and/or obviate the afore-described disadvantages of the conventional tools.

SUMMARY OF THE INVENTION

The primary objective of the present invention is to provide a tool having a light device of greatly simplified configuration that may be easily assembled and may be easily operated.

In accordance with one aspect of the invention, there is provided a tool comprising a body including a base having a chamber formed therein and having at least one socket for receiving a tool bit, at least one battery received in the chamber of the base, a cap attached to the base for retaining the battery in place, a knob pivotally coupled to the cap at a pivot shaft and rotatable between a working position and a closed position, a light bulb secured to the knob and arranged to be exposed when the knob is rotated to the working position, and means for selectively energizing the light bulb when the knob is rotated to the working position, the light bulb being shut off when the knob is rotated to the closed position.

The cap including a pair of panels extended therefrom, the knob is pivotally secured between the panels at the pivot shaft. A retaining means is further provided for retaining the knob in place relative to the cap when the knob is rotated to the working position and for retaining the knob in place relative to the cap when the knob is rotated to the closed position. The cap includes a space for receiving the knob.

The cap includes at least one opening formed therein for aligning with the socket and for allowing the tool bit to be disengaged from the base and the cap when the opening is aligned with the socket. The base includes a channel member, the cap includes a rib member for slidably engaging with the channel member of the base and for attaching the cap to the base, the base includes a first depression and a second depression formed therein, the cap includes a projection for selectively engaging with the first depression when the opening is aligned with the socket and for selectively engaging with the second depression when the opening is disengaged from the socket.

The battery includes a center electrode and a case electrode, the base includes a first conductor engaged with the case electrode of the battery and includes a second conductor engaged with the center electrode of the battery and includes a third conductor disposed beside the second conductor, the knob includes a fourth conductor and a fifth conductor secured thereto, the light bulb includes two prongs secured to the fourth conductor and the fifth conductor of the knob, a sixth conductor couples the first conductor to the third conductor, and the fourth conductor and the fifth conductor are caused to engage with the second conductor and the third conductor respectively and to energize the light bulb when the knob is rotated to the working position.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
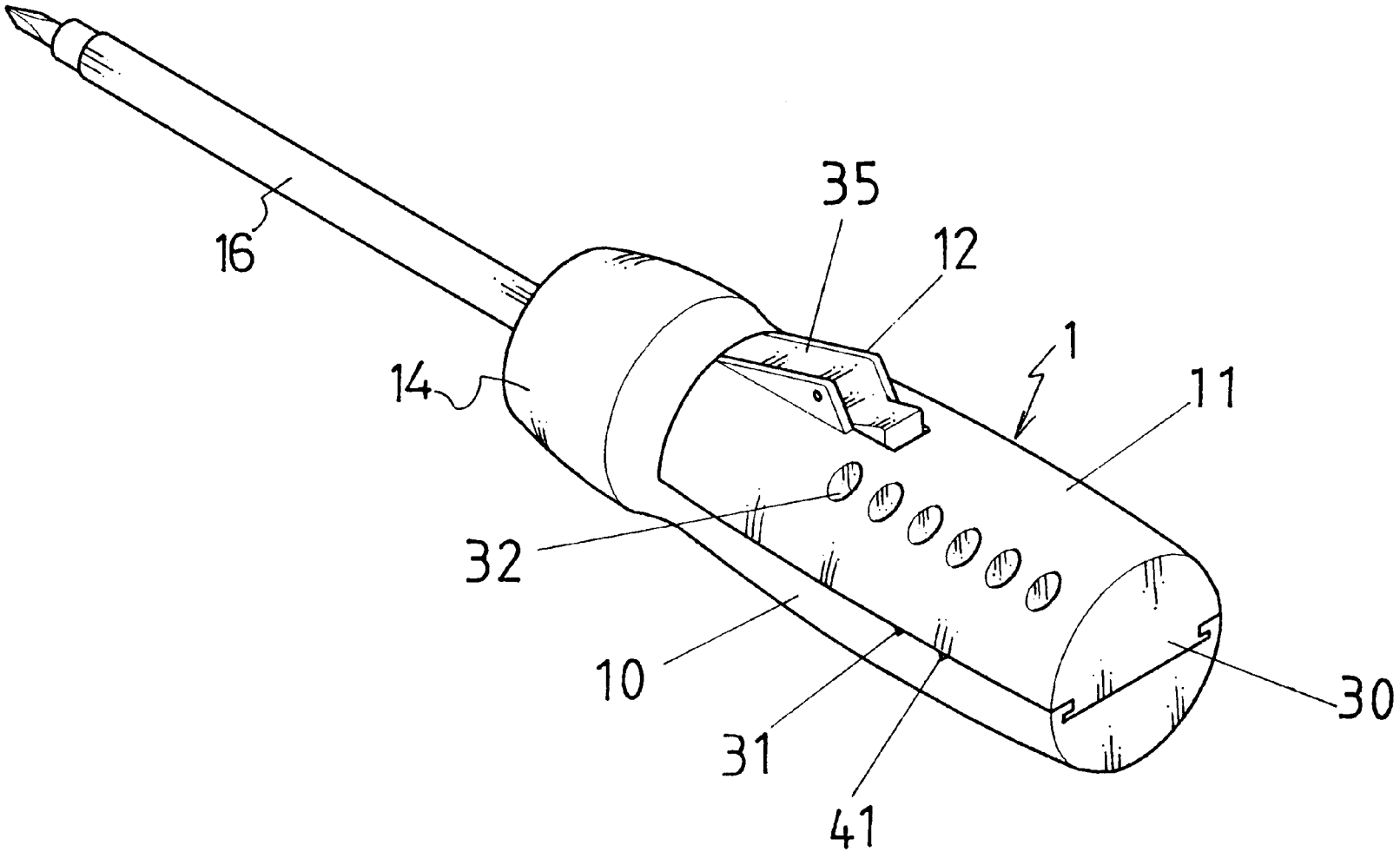
FIG. 1 is a perspective view of a tool in accordance with the present invention.
Figure 2:
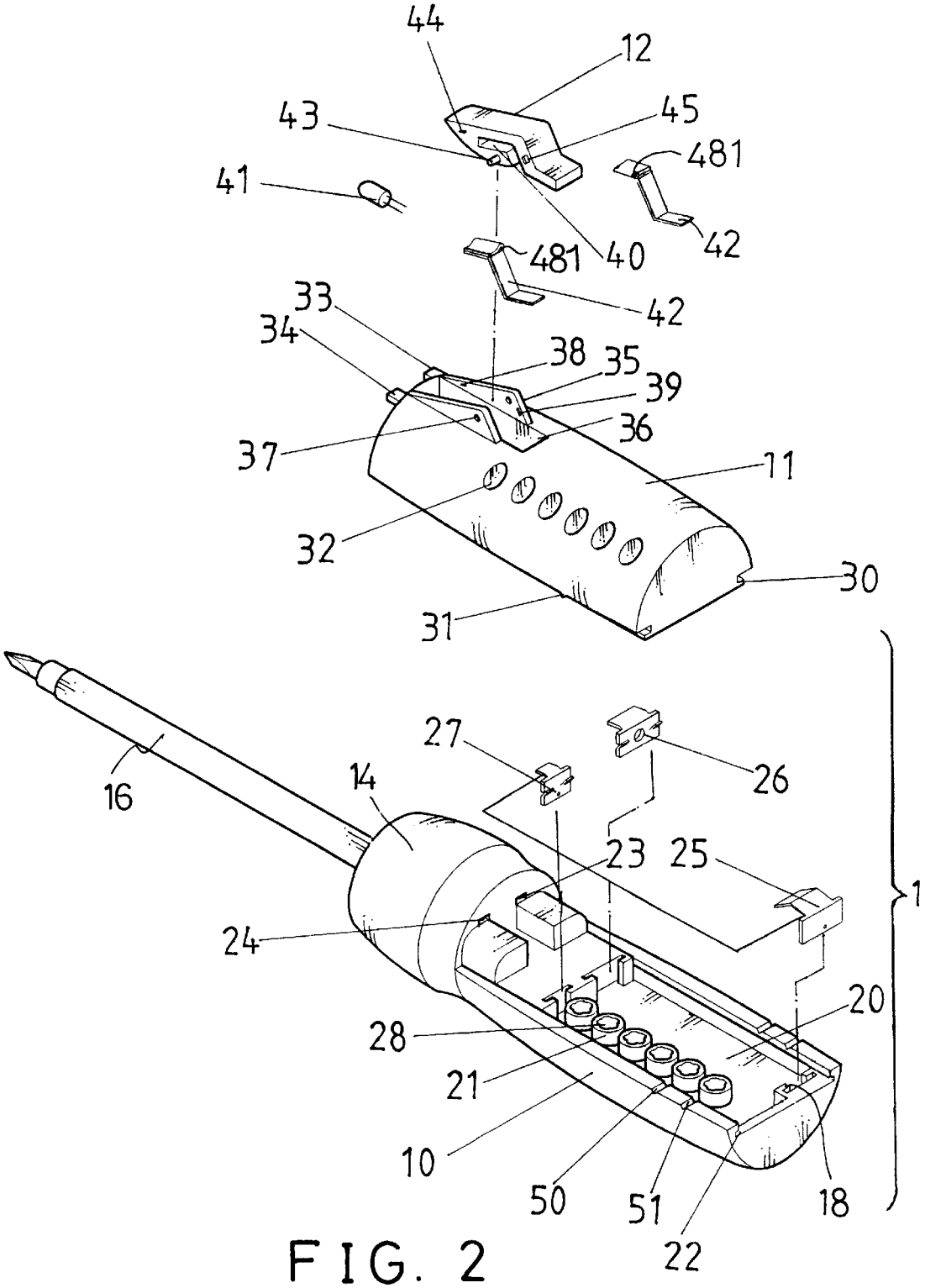
FIG. 2 is an exploded view of the tool.
Figure 3:
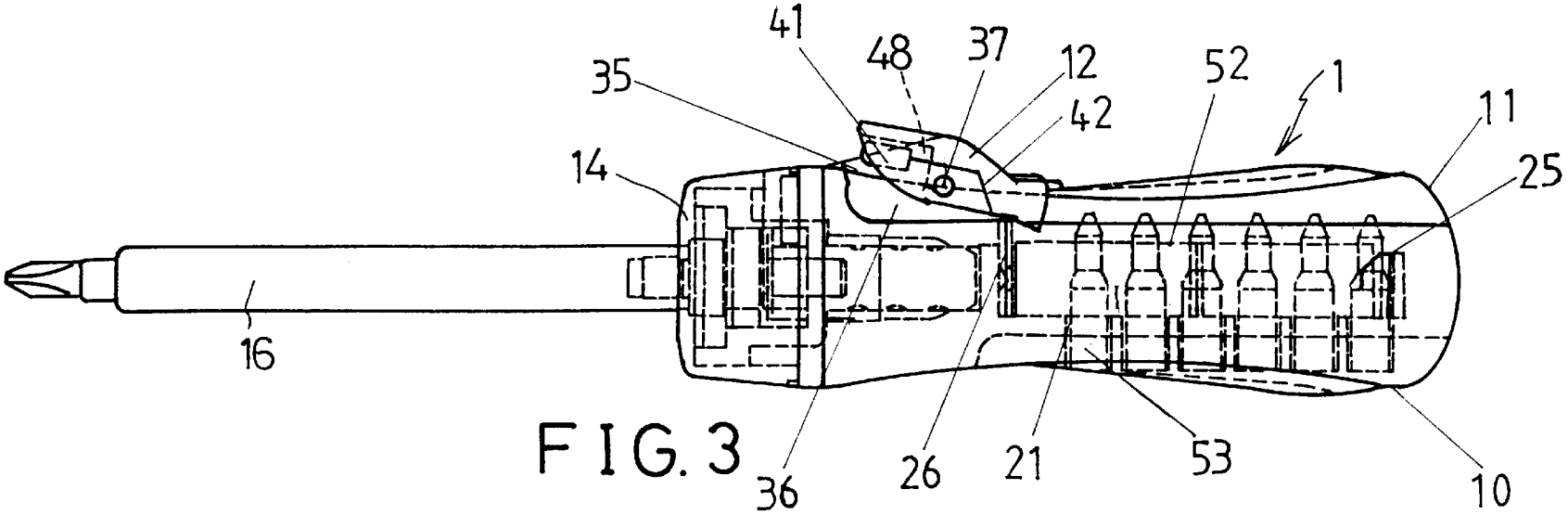
FIGS. 3 and 4 are side views of the tool, in which the inner structure of the tool is shown in dotted lines for illustrating the operation of the tool.

Referring to the drawings, and initially to FIGS. 1–3, a tool in accordance with the present invention, such as a screw driver, comprises a body 1 including a driving stem 16 extended forward from the front end 14 of a base 10 for driving purposes and including one or more punctures 23, 24 formed in the front end 14 and facing rearward. The body 1 may also be the handle of the wrenches. The base 10 of the body 1 includes a chamber 20 for receiving one or more batteries 52, and includes a number of sockets 21 each having a cavity 28 formed therein for receiving a tool bit 53 or a tool extension. The base 10 of the body 1 includes a pair of parallel channels 22 and two depressions 50, 51 formed in the upper portion. The body 1 includes three recesses 18 for receiving three conductors 25, 26, 27 respectively; in which the conductor 25 is engaged with the case electrode of the battery 52 (FIGS. 3–6) and the conductor 26 is engaged with the center electrode of the battery 52. The other conductor 27 is disposed beside the conductor 26 and is electrically coupled to the conductor 25 by a wire or a conductor member 29.

The body 1 includes a cap 11 having a pair of parallel ribs 30 slidably engaged with the channels 22 and having one or more extensions 33, 34 extended forward for engaging with the punctures 23, 24 of the body 10 and for securing the cap 11 to the base 10 and for retaining the batteries 52 and the tool bits 53 in place. The cap 11 includes a projection 31 extended downward for engaging with either of the depressions 50, 51 of the base 10 and for positioning the cap 11 to the base 10. The cap 11 includes a number of openings 32 for aligning with the tool bits 53 (FIG. 6) when the projection 31 is engaged with the depression 51 of the base 10, such that the tool bits 53 may be disengaged from the body 1 via the openings 32. When the cap 11 is moved forward to engage the extensions 33, 34 with the punctures 23, 24 of the base 10 and when the projection 31 is engaged with the other depression 50, the openings 32 are disengaged from the tool bits 53 (FIG. 5) such that the tool bits 53 may be retained in place by the cap 11.

The cap 11 includes a space 36 formed in the front portion for partially receiving a knob 12 and includes a pair of panels 35 extended upward from the cap 11 and arranged such that the space 36 is located between the panels 35. The panels 35 each includes a hole 37 and two orifices 38, 39. The knob 12 includes a shaft 43 pivotally engaged in the holes 37 of the panels 35 for pivotally securing the knob 12 to the panels 35 at the shaft 43. The knob 12 includes two or two pairs of catches 44, 45 for engaging with the orifices 38, 39 and for positioning the knob 12 at a working position (FIG. 3) when the catch 45 is engaged with the orifice 39 and for positioning the knob 12 at a closed position (FIG. 4) when the other catch 44 is engaged with the other orifice 38. The knob 12 includes a pair of grooves 40 for receiving a pair of conductors 42 and includes a notch 48 (FIG. 3) formed in the front portion for receiving a light bulb 41, such as a light-emitting diode. The light bulb 41 includes two prongs engaged in the apertures 481 of the conductors 42 (FIG. 2) and may be exposed when the knob 12 is rotated to the working position (FIG. 3).

Figure 4:
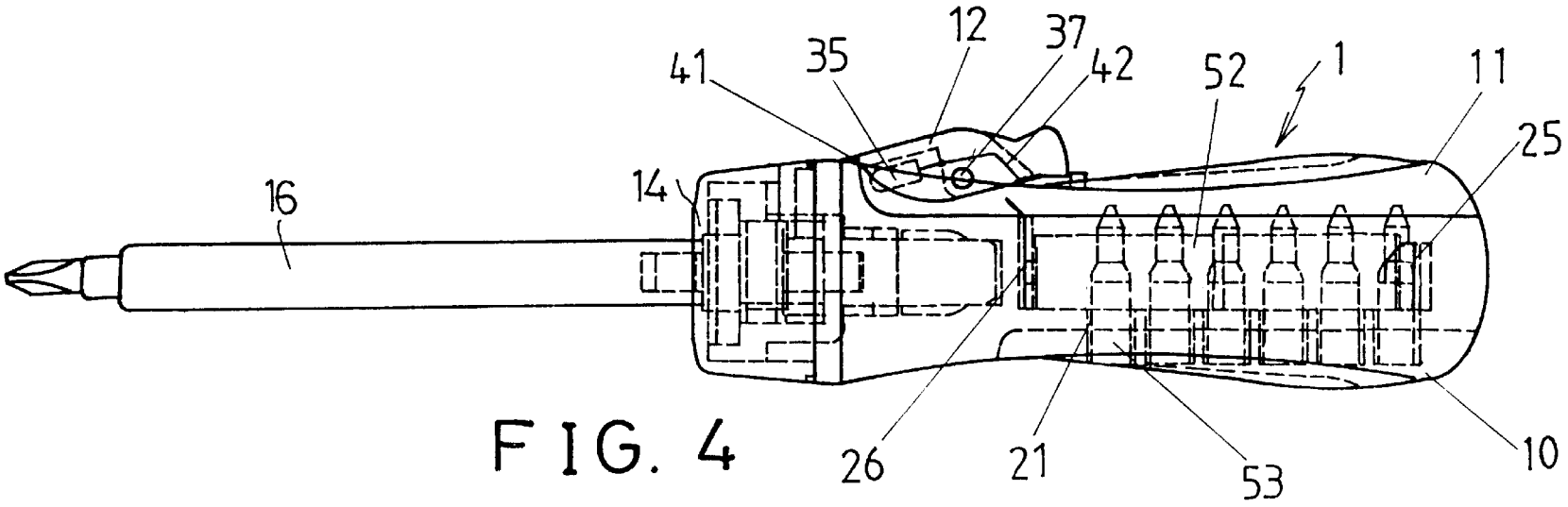
Figure 5:
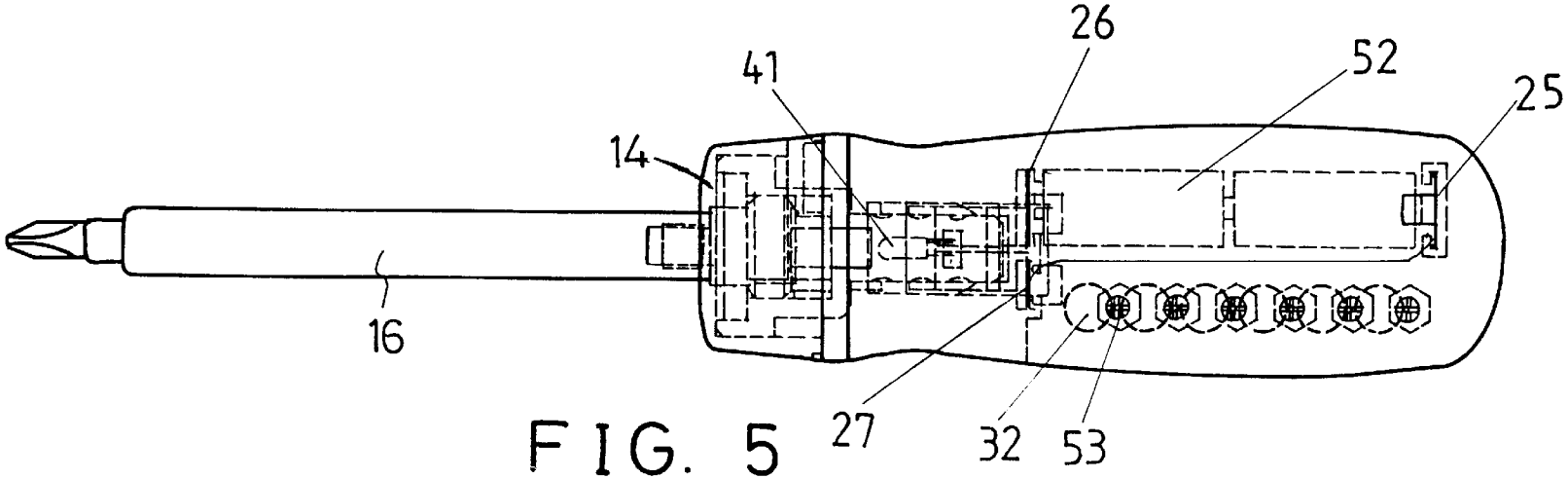
FIGS. 5 and 6 are top views of the tool, in which the inner structure of the tool is shown in dotted lines for illustrating the operation of the tool.
Figure 6:
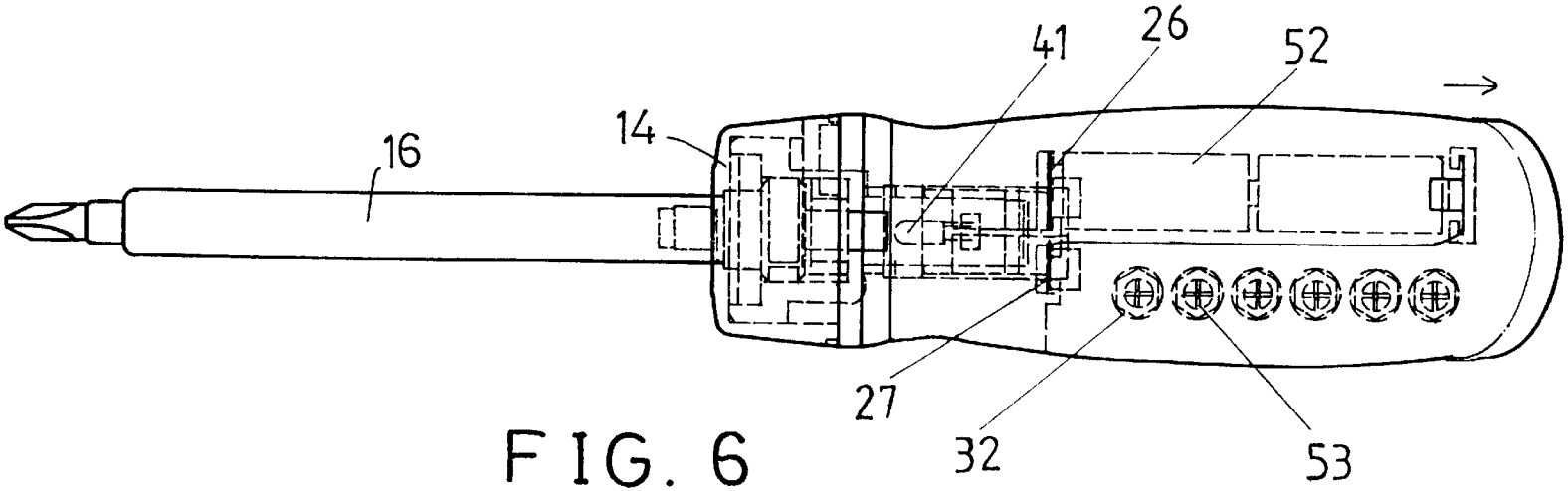

In operation, as shown in FIG. 4, when the knob 12 is rotated to the closed position and retained in place by engaging the catch 44 with the orifice 38 of the cap 11, the conductors 42 are disengaged from the conductors 26, 27 at this moment. As shown in FIG. 3, when the knob 12 is rotated to the working position and retained in place by engaging the catch 45 with the orifice 39 of the cap 11, the conductors 42 are caused to engage with the conductors 26, 27 such that the light bulb 41 may be energized.

Alternatively, without the conductors 27 and the conductors 42, another conductor element may be provided and may include one end electrically coupled to the conductor 25 and may include the other end extended to a position close to the conductor 26. The knob 12 may include a specially designed conductor that may be selectively actuated to electrically couple the conductor element with the conductor 26 when the knob 12 is rotated to the working position.

Accordingly, the tool in accordance with the present invention includes a light device of greatly simplified configuration that may be easily assembled and may be easily operated.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool comprising:

a body including a base having a chamber formed therein and having at least one socket for receiving a tool bit, at least one battery received in said chamber of said base, a cap attached to said base for retaining said at least one battery in said chamber of said base, a knob pivotally coupled to said cap at a pivot shaft and rotating between a working position and a closed position, a light bulb secured to said knob and arranged to be exposed when said knob is rotated to said working position, and means for selectively energizing said light bulb when said knob is rotated to said working position, said light bulb being shut off when said knob is rotated to said closed position.

2. The tool according to claim 1, wherein said cap including a pair of panels extended therefrom, said knob is pivotally secured between said panels at said pivot shaft.

3. The tool according to claim 2 further comprising means for retaining said knob in place relative to said cap when said knob is rotated to said working position.

4. The tool according to claim 2 further comprising means for retaining said knob in place relative to said cap when said knob is rotated to said closed position.

5. The tool according to claim 1, wherein said cap includes a space for receiving said knob.

6. The tool according to claim 1, wherein said cap includes at least one opening formed therein for aligning with said at least one socket and for allowing the tool bit to be disengaged from said base and said cap when said at least one opening is aligned with said at least one socket.

7. The tool according to claim 6, wherein said base includes a channel member, said cap includes a rib member for slidably engaging with said channel member of said base and for attaching said cap to said base, said base includes a first depression and a second depression formed therein, said cap includes a projection for selectively engaging with said first depression when said at least one opening is aligned with said at least one socket and for selectively engaging with said second depression when said at least one opening is disengaged from said at least one socket.

8. The tool according to claim 1, wherein said at least one battery includes a center electrode and a case electrode, said base includes a first conductor engaged with said case electrode of said at least one battery and includes a second conductor engaged with said center electrode of said at least one battery and includes a third conductor disposed beside said second conductor, said knob includes a fourth conductor and a fifth conductor secured thereto, said light bulb includes two prongs secured to said fourth conductor and said fifth conductor of said knob, a sixth conductor couples said first conductor to said third conductor, and said fourth conductor and said fifth conductor are caused to engage with said second conductor and said third conductor respectively and to energize said light bulb when said knob is rotated to said working position.

* * * * *